United States Patent [19]

Cook

[11] 4,182,089

[45] Jan. 8, 1980

[54] INTERLOCKING BUILDING BLOCK

[76] Inventor: Harry M. Cook, Box 11886, Reno, Nev. 89510

[21] Appl. No.: 846,983

[22] Filed: Oct. 31, 1977

[51] Int. Cl.[2] ..... E04B 2/16; E04B 1/02; E04C 1/10

[52] U.S. Cl. ..... 52/284; 52/562; 52/574; 52/594; 52/580

[58] Field of Search ..... 52/562–568, 52/284–286, 427, 592, 594, 574, 580, 593, 505, 503, 504, 567

[56] References Cited

U.S. PATENT DOCUMENTS

| | | | |
|---|---|---|---|
| 2,205,419 | 6/1940 | Kraemer | 52/594 |

FOREIGN PATENT DOCUMENTS

| | | | |
|---|---|---|---|
| 48006 | 10/1933 | Denmark | 52/594 |
| 812828 | of 1951 | Fed. Rep. of Germany | 52/562 |
| Ad.56663 | 7/1952 | France. | |
| 1002072 | 10/1952 | France. | |
| 1041448 | 5/1953 | France | 52/293 |
| 1172655 | 10/1958 | France | 52/562 |
| 420064 | 4/1947 | Italy | 52/574 |
| 227 | of 1913 | United Kingdom | 52/580 |

*Primary Examiner*—James L. Ridgill, Jr.
*Attorney, Agent, or Firm*—Dean and Flickinger

[57] ABSTRACT

Spaced apart webs extend between upright sidewalls of a block having parallel upper and lower surfaces. A plurality of the blocks are placed in staggered linear courses to form a wall. Projections extending upwardly from the webs of the blocks are secured in the spaces between the webs of the blocks of the successive course. The projections interlock with the sidewalls for lateral alignment of the blocks, and are spaced from the webs for longitudinal adjustment of the blocks. Corner blocks and end blocks are also provided.

3 Claims, 13 Drawing Figures

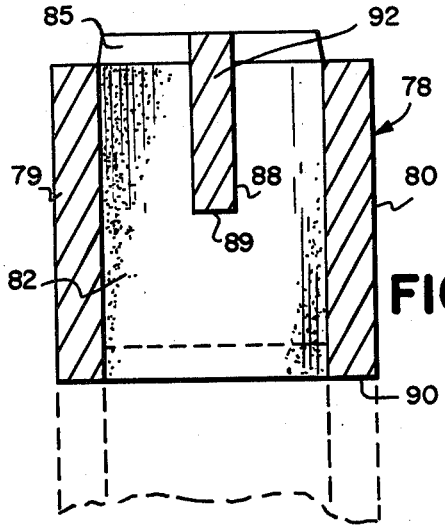
FIG.9.
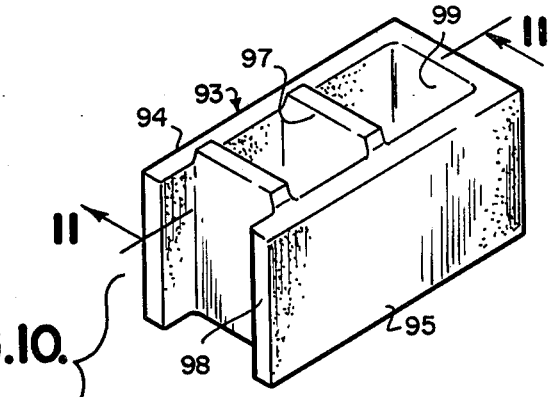
FIG.10.
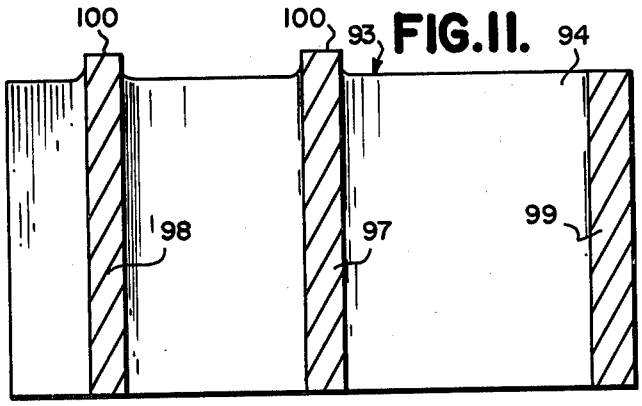
FIG.11.
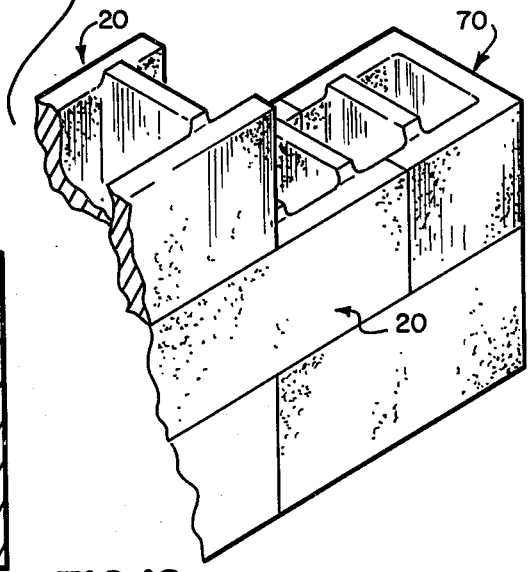
FIG.12.
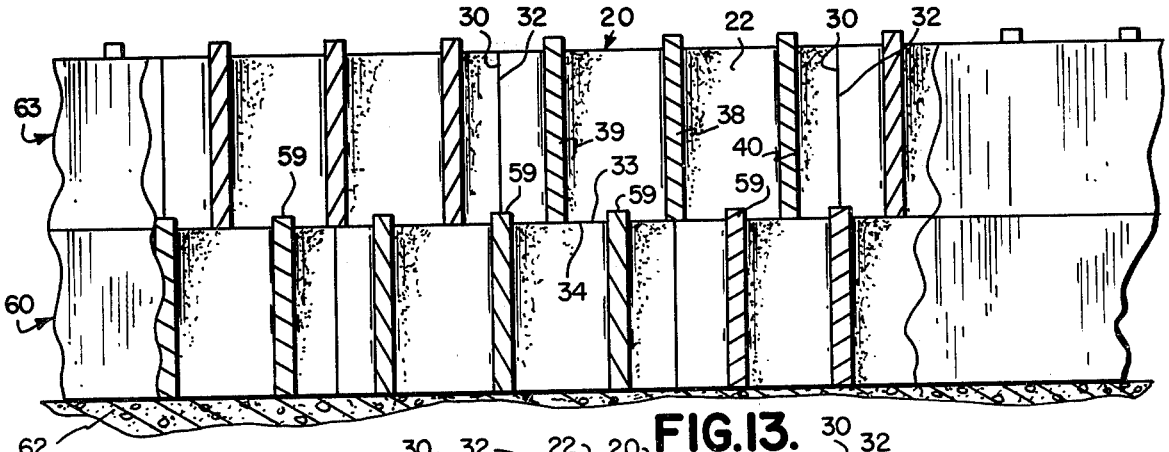
FIG.13.
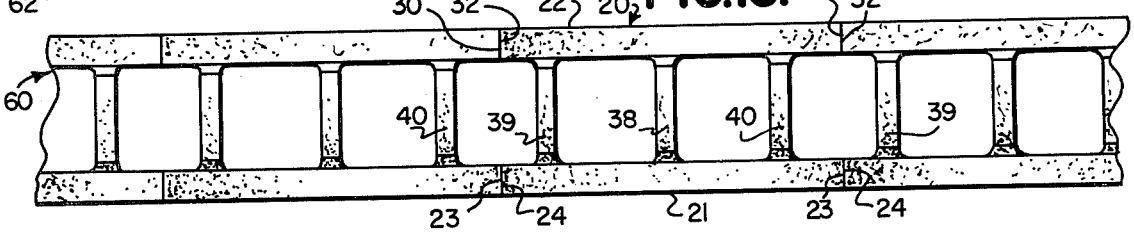

INTERLOCKING BUILDING BLOCK

This invention relates to building blocks.

More particularly, the present invention relates to building blocks, usually pre-cast of cementuous materials and used for the construction of walls and similar structures.

In a further aspect, the instant invention concerns a building block of the type in which the blocks of one course interlock the blocks of a successive course.

The use of building blocks in the construction art is well established. The blocks, usually of a cementuous material, are pre-cast at a manufacturing plant, and subsequently transported to a construction site. For the erection of walls and similar structures, the blocks are placed in end to end alignment in rows, commonly referred to as courses. The first course is generally placed upon a pre-prepared foundation. A second course is placed in staggered alignment upon the first course. Additional courses are added until the desired height of the structure is achieved. The courses are staggered such that the abuttment between two blocks resides approximately centered over a single block of a successively lower course.

The prior art is replete with various building blocks for construction purposes, as briefly described above, commonly include a pair of spaced apart upright sidewalls having transverse webs extending therebetween. The standard conventional block has three webs, and upper and lower flat parallel surfaces. As the structure is erected block by block, mortar is placed between the ends of the blocks of a single course and between the upper and lower surfaces of blocks of successive courses. The art of laying conventional blocks requires exacting skill, as each block must be leveled and aligned vertically and horizontally with respect to the other blocks of the structure.

In order to decrease the level of skill required, decrease time requirements and generally expedite block laying, the prior art has proposed various schemes of interlocking blocks. In general, interlocking blocks incorporate male and female connection means which impart absolute placement between adjacent blocks. In fact, the interlocking means associated with some blocks has reached such a degree of sophistication and development that the blocks are properly advertised as being "mortarless". Recently, adhesives have been developed for bonding interlocking blocks in lieu of traditional mortar.

Building blocks are generally fabricated of a cementuous material, such as concrete and equivalent mixtures. The blocks are cast in a mold, removed when set and subsequently cured. It is well known that it is extremely difficult, if not impossible, to hold accurate tolerances, considering the material and the manufacturing technique. Accordingly, the finished structure will reflect the manufacturing inaccuracies. The deviations from standard dimension are relatively small and are relatively inconsequential when considered laterally across the single block width of a wall. Longitudinally, however, the air can accumulate along the many blocks generally laid in a single course, resulting in a highly inaccurate and unsightly end or corner.

It would be highly advantageous, therefore, to remedy the deficiencies inherent in the prior art.

Accordingly, it is an object of the present invention to provide an improved building block of the interlocking type for construction of walls and similar structures.

Another object of the invention is the provision of a building block that is readily cast or molded of various cementuous materials.

And, another object of the invention is to provide a building block in which the block of one course interlock with the blocks of adjacent courses.

Still another object of the invention is the provision of an interlocking building block which can be fabricated in accordance with conventional manufacturing techniques.

A further object of this invention is to provide an interlocking block which can be adjusted at the time of construction to compensate for manufacturing tolerances.

And a further object of the invention is the provision of an interlocking block which is adapted to be set with conventional mortar or various adhesives or bonding agents.

Yet a further object of the instant invention is to provide a building block which does not require special tools or skills for structural use.

And yet a further object of the invention is the provision of an interlocking building block of the above type which is relatively simple and economical to manufacture.

Still a further object of this invention is to provide an interlocking building block system, including main blocks, end blocks and corner blocks, as may be needed for different structures.

Briefly, to achieve the desired objectives of the instant invention in accordance with a preferred embodiment thereof, provided is a block which includes a pair of spaced upright sidewalls which extend between first and second ends and upper and lower parallel surfaces. Webs extend laterally across the blocks between the sidewalls. In accordance with a preferred embodiment of a main block configuration, provided are three webs, a central web and a web proximate each end. The outer webs are spaced from respective ends a distance which is one-half the distance between the center web and the end webs. A projection extends upwardly from each web beyond the upper surface of the block. The projection has a length corresponding to the distance between the sidewalls and has a thickness less than the distance between webs.

The blocks are laid in staggered linear courses in accordance with conventional practice. The blocks of a second course are laterally aligned by the fit between the respective projections and sidewalls. However, the blocks are longitudinally adjustable to compensate for manufacturing inaccuracies or thickness of mortar or bonding agent.

In accordance with an end block configuration, one of the webs provides an end wall for the block. End blocks are substantially shorter than main blocks and utilize two webs. A corner block has a projection extending longitudinall of the block between webs to receive the perpendicular placed first block of a successive course.

The foregoing and further and more specific objects and advantages of the instant invention will become readily apparent to those skilled in the art from the following detailed description of preferred embodiments thereof taken in conjunction with the drawings, in which:

FIG. 9 is a vertical sectional view taken along the line 9—9 of FIG. 8;

FIG. 10 is an enlarged exploded perspective view of a portion of the structure of FIG. 5 and illustrating another embodiment of an end block;

FIG. 11 is a vertical sectional view taken along the line 11—11 of FIG. 10;

FIG. 12 is an elevation view of a fragmentary section of a structure incorporating building blocks of the instant invention and partially broken away to reveal further details;

FIG. 13 is a top plan view of the fragmentary structure illustrated in FIG. 11.

Figure 1:
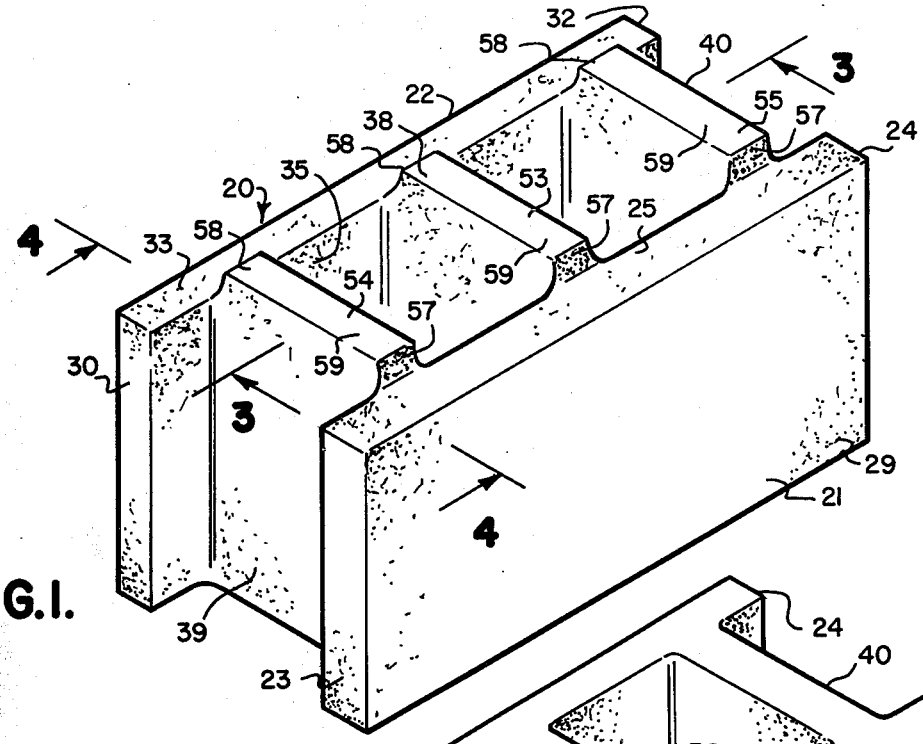
FIG. 1 is a perspective view, especially showing the top, of a main block of the interlocking type constructed in accordance with the teachings of the instant invention.
Figure 2:
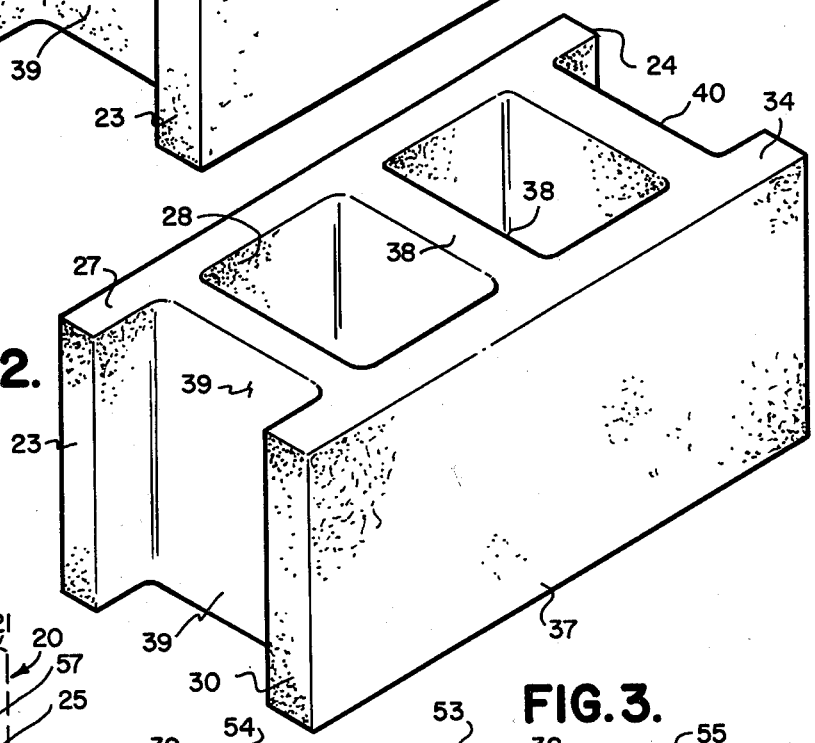
FIG. 2 is a perspective view of the block of FIG. 1, said block having been inverted to display the underside thereof.

Turning now to the drawings, in which like reference characters denote corresponding elements throughout the several views, attention if first directed to FIG. 1, which shows a building block constructed in accordance with the teachings of the instant invention and generally designated by the reference character 20, which, in common with prior art building blocks, includes a pair of spaced upright sidewalls 21 and 22. Side 21 is also seen in FIG. 2, as first end 23, second end 24, top edge 25, bottom edge 27 and inner and outer surfaces 28 and 29, respectively. Similarly, sidewall 22 has first end 30, second end 32, top edge 33, bottom edge 34 and inner and outer surfaces 35 and 37, respectively.

Upright webs 38, 39 and 40 extend between sidewalls 21 and 22. Top edges 25 and 33 of sidewalls 21 and 22, respectively, comprise the upper surface of block 20. Similarly, bottom edges 27 and 34 of sidewalls 21 and 22, respectively, comprise the lower surface of block 20. The upper surface and the lower surface of the block are parallel. The first end of block 20 is defined by first end 23 of sidewall 21 and first end 30 of sidewall 22. Similarly, second ends 24 and 32 of sidewalls 21 and 22, respectively, comprise the second end of block 20.

Figure 3:
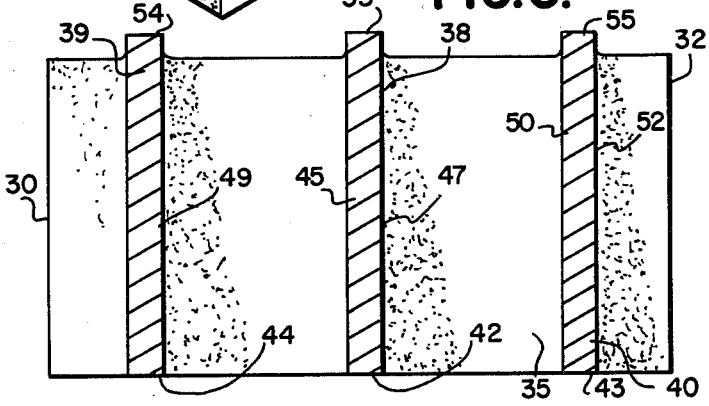
FIG. 3 is a vertical sectional view taken along the line 3—3 of FIG. 1.

The number of webs in a building block, fabricated in accordance with the teachings of the instant invention, is variable in accordance with the needs of the user. The immediate embodiment, illustrated in FIGS. 1–3, incorporates three webs 38, 39 and 40, which, for purposes of reference are considered the first, second and third webs, respectively. Webs 38, 39 and 40 have bottom edges 42, 43 and 44, respectively, which are flush with bottom edges 27 and 34 and the lower surface of block 20. First web 38 includes first and second sides 45 and 47, respectively. Second web 39 includes first and second sides 48 and 49, and third web 40 has first side 50 and second side 52. As will be explained in further detail presently, the distance between sides 45 and 49 is equal to the distance between sides 47 and 50. The distance between end 30 and side 48 is equal to the distance between end 32 and side 52. The latter distances are one-half of the former distances.

Projections 53, 54 and 55 extend upwardly from webs 38, 39 and 40, respectively, Each projection has first and second ends 57 and 58, respectively, and upper edge 59. Each end 57 and 58 is inclined inwardly upward.

Figure 4:
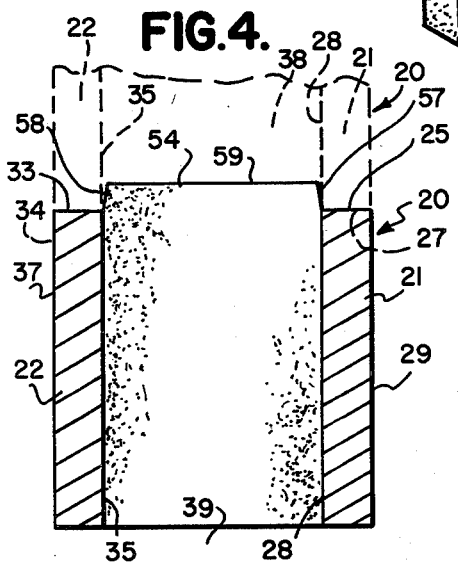
FIG. 4 is a vertical sectional view taken along the line 4—4 of FIG. 1 and partially illustrating a block of a successive course in block outline.

As seen in cross section in FIG. 4, sidewalls 21 and 22 have inner surfaces 28 and 35, respectively. The length of each projection 53, 54 and 55, at the base thereof, corresponds to the distance between inner surfaces 28 and 35 at the bottom surface of block 20. The slope of ends 57 and 59 is inwardly and away from inner surfaces 28 and 35. Accordingly, a subsequent block, as shown in broken outline, will nestle upon a lower block. Since the length of upper edge 59 of the projection is less than the distance between sidewals 21 and 22 at the bottom surface of the block, initial placement of the subsequent block is facilitated and the upper block is guided into place. It will be appreciated that surfaces 28 and 35 may be manufactured vertically and parallel, or sloping for mold release purposes.

Figure 5:
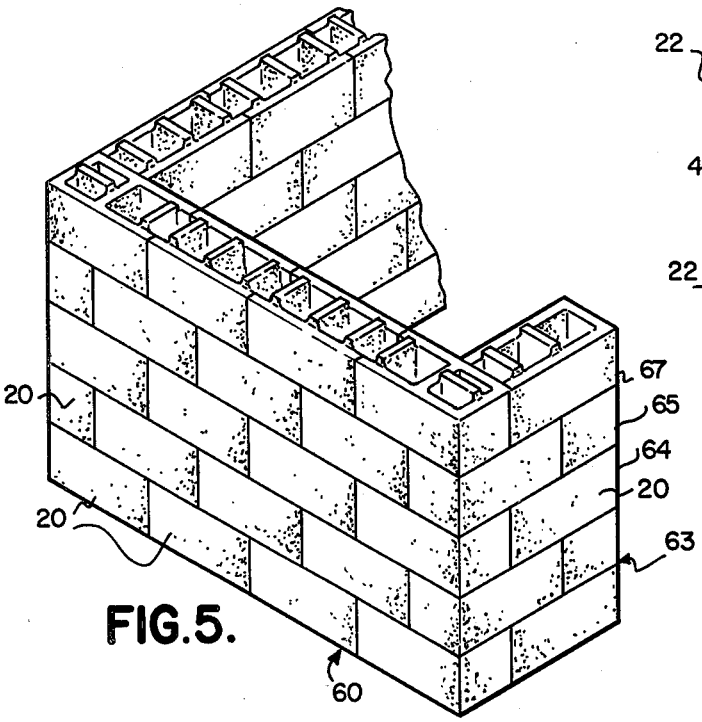
FIG. 5 is a perspective view of a fragmentary portion of a structure constructed with the building blocks of the instant invention.
Figure 6:
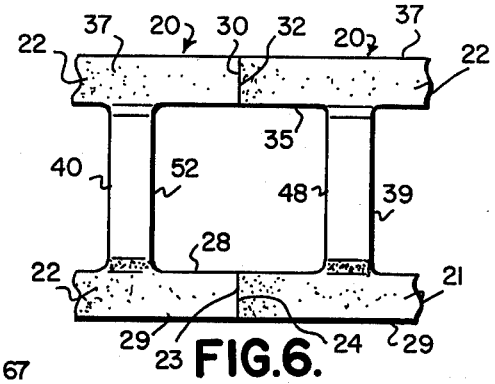
FIG. 6 is a plan view of an enlarged fragmentary section of the structure of FIG. 5, particularly illustrating the abutment of two of the building blocks thereof.

In accordance with conventional practice, the building blocks of the instant invention are placed end to end to form linear courses, as seen in FIGS. 5, 6 and 13. A first course 60 is placed upon a foundation 62, or other suitably prepared surface, as is also viewed in FIG. 12. A second course 63 is placed upon the first course and subsequent courses 64, 65, 67, as needed, are added until the desired height of the structure is attained. Various bonding agents can be used between the blocks of a given course and between the blocks of adjacent courses. Exemplary bonding agents are conventional mortar, silica based adhesives and epoxies. A recommended bonding agent is the Protex brand adhesive mortar, sold under the trade name of "Thin Weld" manufactured by Protex Industries, Denver, Colorado.

Within a given course, the blocks are abutted end to end, as illustrated in FIGS. 6 and 13. Ends 24 and 32 of one block are abutted against ends 23 and 30, respectively, of an adjacent block. Within a course, all webs are equally spaced. The spacing between webs 39 and 40 of adjacent blocks is the same as the spacing between webs 38 and 39 and between 38 and 40 within a single block.

The blocks are laid in staggered courses, in accordance with conventional practice. The abutment between two blocks of a second course resides at the approximate mid point of a block of the first course. Each projection 59 of a first course is, therefore, approximately centered between respective webs of a second course. The engagement of ends 57 and 58 against inner surfaces 28 and 35 provides lateral alignment between the blocks of a first course and a second course. Since a conventional structure generally involves only one block in the lateral direction, manufacturing inconsistencies are considered negligible. However, since a multiplicity of blocks must be considered longitudinally within a given course, tolerance errors are accumulative and a second course of blocks potentially can be substantially longer or shorter than the first course. As particularly apparent in FIG. 12, each block 20 of second course 63 is longitudinally adjustable with respect to the blocks 20 of first course 60. Therefore, each block 20 of second course 63 can be longitudinally aligned as it is placed upon first course 60. The adjustment of each block 20 of second course 63 will be relatively minor and can be accounted for by a relatively thinner or thicker layer of adhesive.

Figure 7:
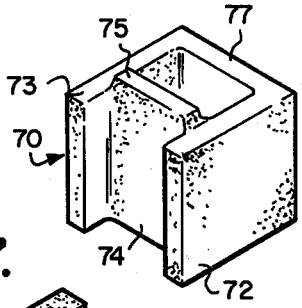
FIG. 7 is an enlarged exploded fragmentary perspective view of a portion of the structure of FIG. 5 particularly illustrating an end block embodying the teachings of the instant invention.

Other building blocks are fabricated in accordance with the teachings of the instant invention, in order to provide a construction system. Seen in FIG. 7 is an end block which is used to complete a course, as will be readily appreciated by those skilled in the art. Analogous to previously described block 20, end block 70 includes spaced upright sidewalls 72 and 73 and first web 74 with projection 75, each having respective ends, edges and surfaces as previously described. Second web 77 is placed at one end of block 70 and forms an end wall to lend a finished appearance to an end of a course.

Figure 8:
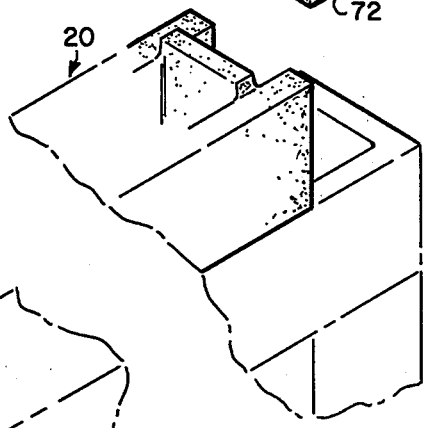
FIG. 8 is an enlarged exploded fragmentary perspective view of a corner portion of the structure of FIG. 5 and particularly showing a corner block of the instant invention.
Figure 8:
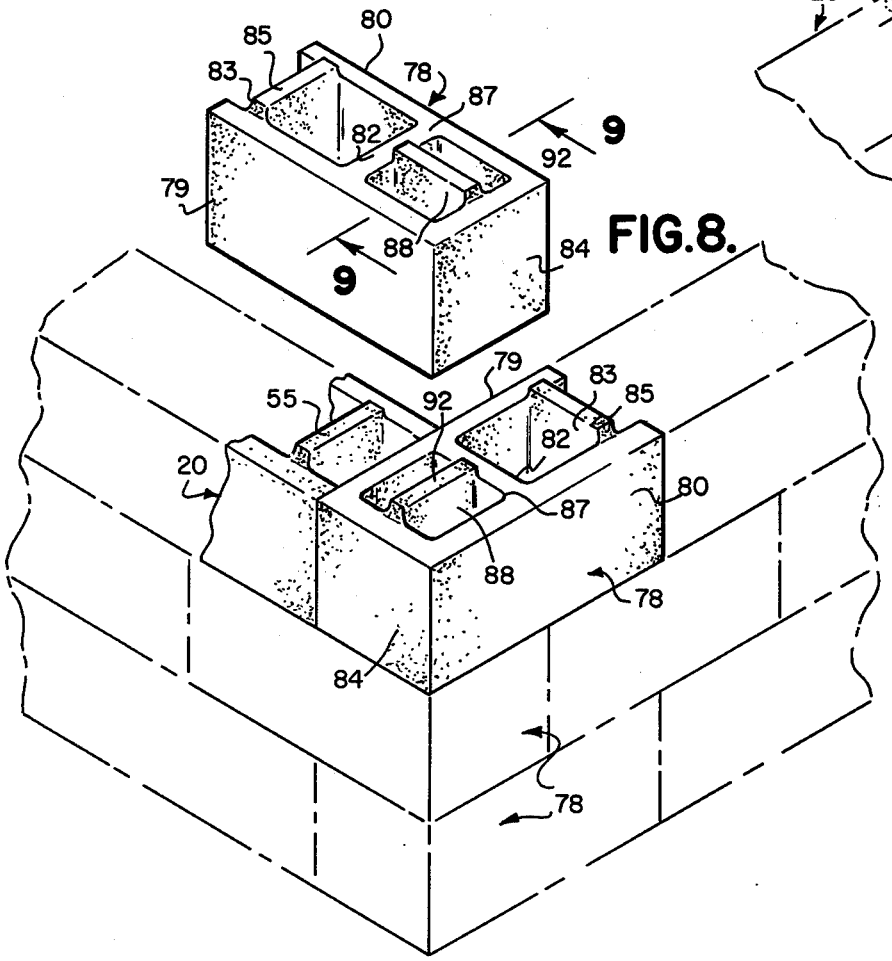

FIGS. 8 and 9 illustrate a corner block 78 having spaced upright sidewalls 79 and 80 and first, second and third webs 82, 83 and 84, respectively. Second web 83 is generally similar to previously described second web 39, including projection 85 extending upwardly therefrom which is sized and shaped in accordance with previously described projection 54. First web 82 does not include a projection and has an upper edge 87 which is substantially flush with the upper surface of block 78. Third web 84 also terminates with the upper surface of block 78 and functions as an end wall at one end of block 78.

Supplementary web 88, as is further illustrated in FIG. 9, extends between first web 82 and third web 84 generally parallel to sidewalls 79 and 80. Web 88 is approximately centered between sidewalls 79 and 80 and has a lower edge 89 which terminates at a point above the lower surface of block 78. Thus, web 88 does not interfere with the web of the adjacent lower block which is received between sidewalls 78 and 80 and between webs 82 and 84. Projection 92 extends upwardly from web 88 and is received between the sidewalls of a successive adjacent block, as previously described. A plurality of blocks 78 are used to fabricate the corner of a structure, each successive block being roated at a right angle within a horizontal plane relative the previous block.

An alternate end block 93 is illustrated in FIGS. 10 and 11. End block 93, in general similarity to the previously described blocks, includes a pair of spaced upright sidewalls 94 and 95 with first, second and third webs 97, 98 and 99. Webs 97 and 98 are provided with projection 100, also as previously described. Web 99 is without a projection and forms an end wall for block 93.

A structure is terminated with end blocks to provide a finished appearance. Due to the staggered arrangement of the courses, alternating courses require half size and full size end blocks, as will be readily understood by those skilled in the art. Thus, it is seen that main blocks 20, end blocks 70 and 93 and corner blocks 78 provide a construction system for the erection of walls, fences and other structures of various configurations.

Various modifications and variations to the embodiments herein chosen for purposes of illustration will readily occur to those skilled in the art. To the extent that such modifications and variations do not depart from the spirit of the invention, they are intended to be included within the scope thereof, which is limited only by a fair interpretation of the following claims.

Having fully described and disclosed the invention and preferred embodiments thereof in such clear and concise terms as to enable those skilled in the art to understand and practice the same, the invention claimed is:

1. In an interlocking building block for the construction of walls and similar structures, which block includes a pair of spaced upright sidewalls extending between first and second ends and parallel upper and lower surfaces, and which structures include a first linear course of said blocks placed first end to second end and a second linear course of said blocks placed first end to second end upon said first course, the blocks of said second course being staggered with respect to the blocks of said first course, improvements therein comprising:

(a) a first upright web extending laterally across said block between said sidewalls and having a main body portion that is co-extensive in height with said sidewalls;

(b) a second upright web extending laterally across said block between said sidewalls; having a main body portion that is co-extensive in height with said sidewalls and spaced from said first web, said first web being spaced from the first end of said block a distance equal to one-half the distance between said first and second webs said second web constituting an end wall at the second end of said block;

(c) a third upright web constituting the second end of said block and spaced from said second web a distance equal to the spacing between said first and said second webs; said third web having a main body portion co-extensive with said sidewall and a projection extending upwardly from said third web beyond the upper surface of said block;

(d) a projection extending upwardly from the main body portion of said first web beyond the upper surface of said block, said projection having a length corresponding to the distance between said sidewalls and having a thickness less than the distance between said first and second webs; and wherein said third web is spaced from said second web of said block a distance equal to one-half the distance between said web and first end of said block;

whereby the projection of a said block of said first course is re-received between the sidewalls and between the first and second web of a said block of said second course, and whereby said block of said second course is laterally located and longitudinally adjustable relative to said block of said first course.

2. In an interlocking building block for the construction of walls and similar structures, which block includes a pair of spaced upright sidewalls extending between first and second ends and parallel upper and lower surfaces, and which structures include a first linear course of said blocks placed first end to second end and a second linear course of said blocks placed first end to second end upon said first course, the blocks of said second course being staggered with respect to the blocks of said first course, improvements therein comprising:

(a) a first upright web extending laterally across said block between said sidewalls and having a main body portion that is co-extensive in height with said side walls;

(b) a second upright web extending laterally across said block between said sidewalls; having a main body portion that is co-extensive in height with said side walls and spaced from said first web, said first web being spaced from the first end of said block a distance equal to one-half the distance between said first and second webs said second web constituting an end wall at the second end of said block;

(c) a third upright web constituting the second end of said block and spaced from said second web a distance equal to the spacing between said first and said second webs; said third web having a main body portion co-extensive with said side wall and a projection extending upwardly from said third web beyond the upper surface of said block;

(d) a projection extending upwardly from the main body portion of said first web beyond the upper surface of said block, said projection having a length corresponding to the distance between said sidewalls and having a thickness less than the distance between said first and second webs;

(e) a supplementary web extending between said second and said third webs generally parallel to said sidewalls and having a bottom edge spaced above the lower surface of said block; and (f) a supplementary projection extending upwardly from said supplementary web beyond the upper surface of said block, said projection having a length corresponding to the distance between said sidewalls and having a thickness less than the distance between said first and second webs;

whereby the projection of a said block of said first course is received between the sidewalls and between the first and second web of a said block of said second course, and whereby said block of said second course is laterally located and longitudinally adjustable relative to said block of said first course.

3. The building block of claim 2, further including:

(a) a projection extending upwardly from said second web beyond the upper surface of said block; and (b) a projection extending upwardly from said third web beyond the upper surface of said block, each said projection having a length corresponding to the distance between said sidewalls and having a thickness less than the distance between said first and second webs.

* * * * *